US007534131B2

(12) United States Patent
Chung

(10) Patent No.: US 7,534,131 B2
(45) Date of Patent: May 19, 2009

(54) FLEXIBLE FLAT CABLE CONNECTOR

(75) Inventor: Chih Ping Chung, Taoyuan County (TW)

(73) Assignee: P-Two Industries Inc. (TW)

( * ) Notice: Subject to any disclaimer, the term of this patent is extended or adjusted under 35 U.S.C. 154(b) by 0 days.

(21) Appl. No.: 12/106,576

(22) Filed: Apr. 21, 2008

(65) Prior Publication Data

US 2009/0011636 A1 Jan. 8, 2009

(30) Foreign Application Priority Data

Jul. 6, 2007 (TW) ..... 96211106 U

(51) Int. Cl.
*H01R 12/24* (2006.01)

(52) U.S. Cl. ..... 439/495; 439/260

(58) Field of Classification Search ..... 439/495, 439/499, 260, 261; 29/33 M; 200/51.09
See application file for complete search history.

(56) References Cited

U.S. PATENT DOCUMENTS 6,062,889 A * 5/2000 Hyland et al. ..... 439/326
6,319,052 B1 * 11/2001 Chang ..... 439/495
6,837,740 B2 * 1/2005 Kunishi et al. ..... 439/495
6,921,274 B2 * 7/2005 Yu ..... 439/260
7,094,093 B2 * 8/2006 Nakano et al. ..... 439/495
7,179,118 B1 * 2/2007 Harlan et al. ..... 439/495
7,255,584 B2 * 8/2007 Takashita ..... 439/260
7,255,594 B2 * 8/2007 Huang et al. ..... 439/495

* cited by examiner

*Primary Examiner*—T C Patel
*Assistant Examiner*—Harshad C Patel
(74) *Attorney, Agent, or Firm*—Bacon & Thomas, PLLC

(57) ABSTRACT

The present invention discloses a flexible flat cable connector comprising an insulating body, a plurality of conductive terminals and a cover. The conductive terminals are inserted into the terminal grooves of the insulating body, and the cover is assembled on the top of the containing space of the insulating body. The first switch terminal and the second switch terminal are disposed in the insulating body, and the first switch terminal is located above the second switch terminal. When a flexible flat cable which has a lobe located at the one side is inserted into the containing space, the lobe of the flexible flat cable can contact against on the first switch terminal which then presses downwardly to the second switch terminal so as to detect whether or not the flexible flat cable is correctly positioned, and cause the flexible flat cable to conduct with the conductive terminal.

11 Claims, 6 Drawing Sheets

FLEXIBLE FLAT CABLE CONNECTOR

FIELD OF THE INVENTION

The present invention is a flexible flat cable connector, and more particularly to a flexible cable connector having a switch terminal block for detecting whether or not the flexible cable is correctly positioned.

BACKGROUND OF THE INVENTION

A common flexible flat cable (FFC) is a product which wraps the signal lines in the plastic insulating film. The feature of the flexible flat cable is bendable, light-weightness, and thinness, and can be deployed associate with the size and the shape of the electrical products, and suitable for thinness and smallness electrical products, such us notebooks, optical disk drives, floppy drives, printers or mobile phones. Generally, the flexible flat cable does not connect to the circuit board directly, but via a connector fixed on the circuit board. Such connectors are called flexible flat connectors.

The flexible flat cable connectors of prior art, as disclosed in the U.S. Pat. No. 7,134,891, comprises an insulating body a movable cover and a plurality of conductive terminals. The conductive terminals are inserted into the insulating body having a containing space. By the above-mentioned structure, the flexible flat cable can insert into the containing space from the front end of the insulating body, then the movable cover is pressed on the surface of the flexible flat cable to force the flexible flat cable being hold between the movable cover and the conductive terminal, so that the contact point of the of the flexible flat cable and the conductive terminal can conduct with each other.

However, the flexible flat cable deflects easily during the installing. Because the conventional flexible flat cable do not equip the function of detecting correct position, the user can not ensure whether the flexible flat cable is correctly positioned. Even thought the movable cover press on the surface of the flexible flat cable, the flexible cable can not conduct electrically, and most people often mistake the problem is caused by the damage of the flexible flat cable, and this causes unnecessary trouble.

So how to solve the problem described above is concerned by the related manufacturers.

In view of the foregoing drawbacks of the prior art, the inventor of the present invention based on years of experience to conduct extensive researches and experiments, and finally invented an flexible flat cable connector to overcome the drawbacks of the prior art.

SUMMARY OF THE INVENTION

The purpose of the present invention is to provide a flexible flat cable connector capable of detecting whether or not the flexible flat cable is correctly positioned after the flexible flat cable is inserted in slot.

The present invention provides a flexible flat cable connector comprising an insulating body, a plurality of conductive terminals and a cover. The conductive terminals are inserted in the terminal grooves of the insulating body, and the cover is assembled on the top of the containing space of the insulating body. A first switch terminal and a second switch terminal are disposed in the insulating body. The first switch terminal is arranged on the top of the second switch terminal. When a flexible flat cable which has a lobe on one side is inserted in the containing space, the lobe of the flexible flat cable can contact against the first switch terminal for detecting whether or not the flexible flat cable is positioned correctly, and enabling the flexible flat cable and the conductive terminal to conduct with each other.

BRIEF DESCRIPTION OF THE DRAWINGS

The subject matter regarded as the invention is particularly pointed out and distinctly claimed in the concluding portion of the specification. The invention, both as to device and method of operation, together with features and advantages thereof may best be understood by reference to the following detailed description with the accompanying drawings in which:

DETAILED DESCRIPTION OF THE PREFERRED EMBODIMENTS

Figure 1:
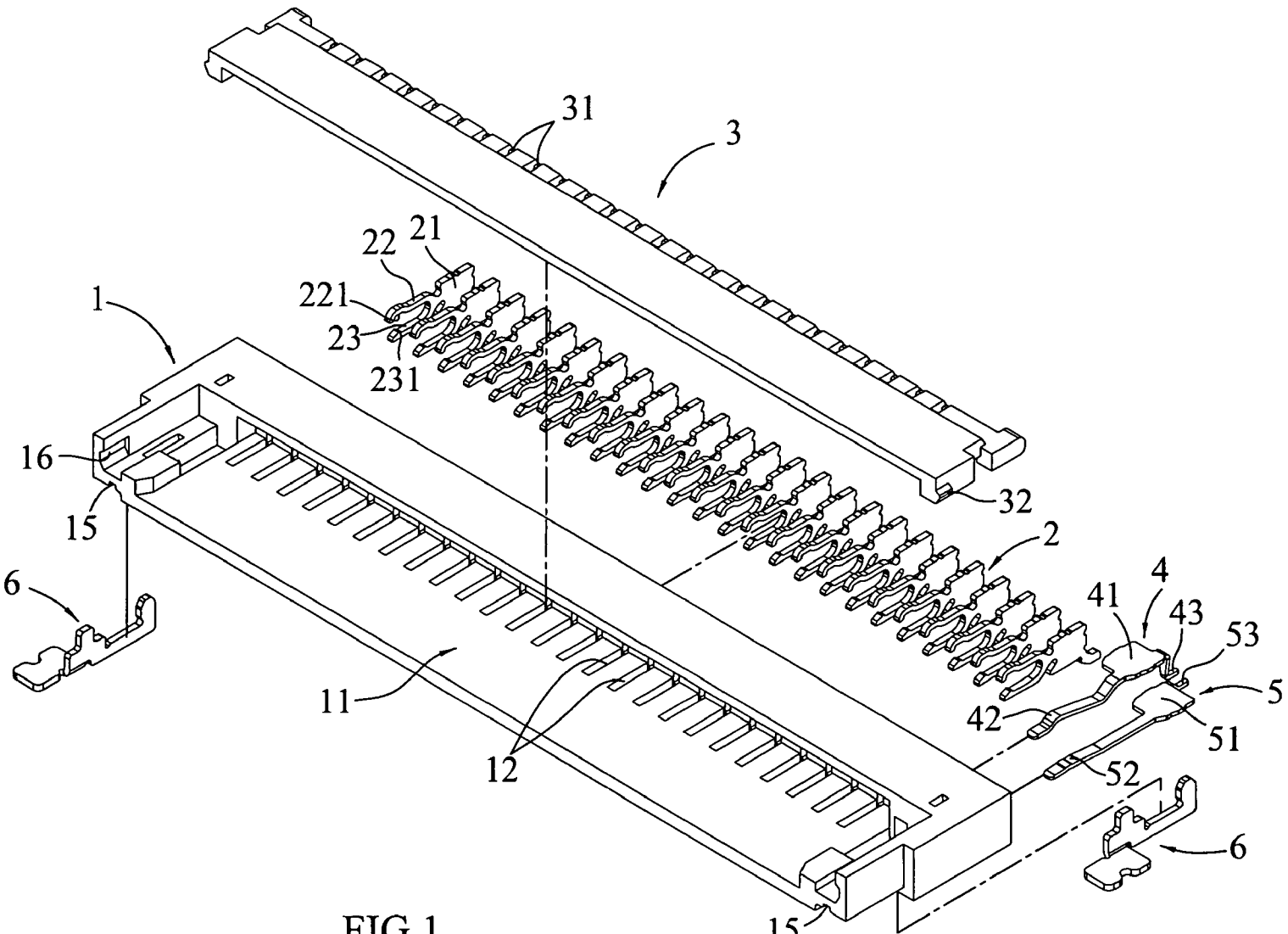
FIG. 1 illustrates an exploded view of the flexible flat cable connector of the present invention.
Figure 2:
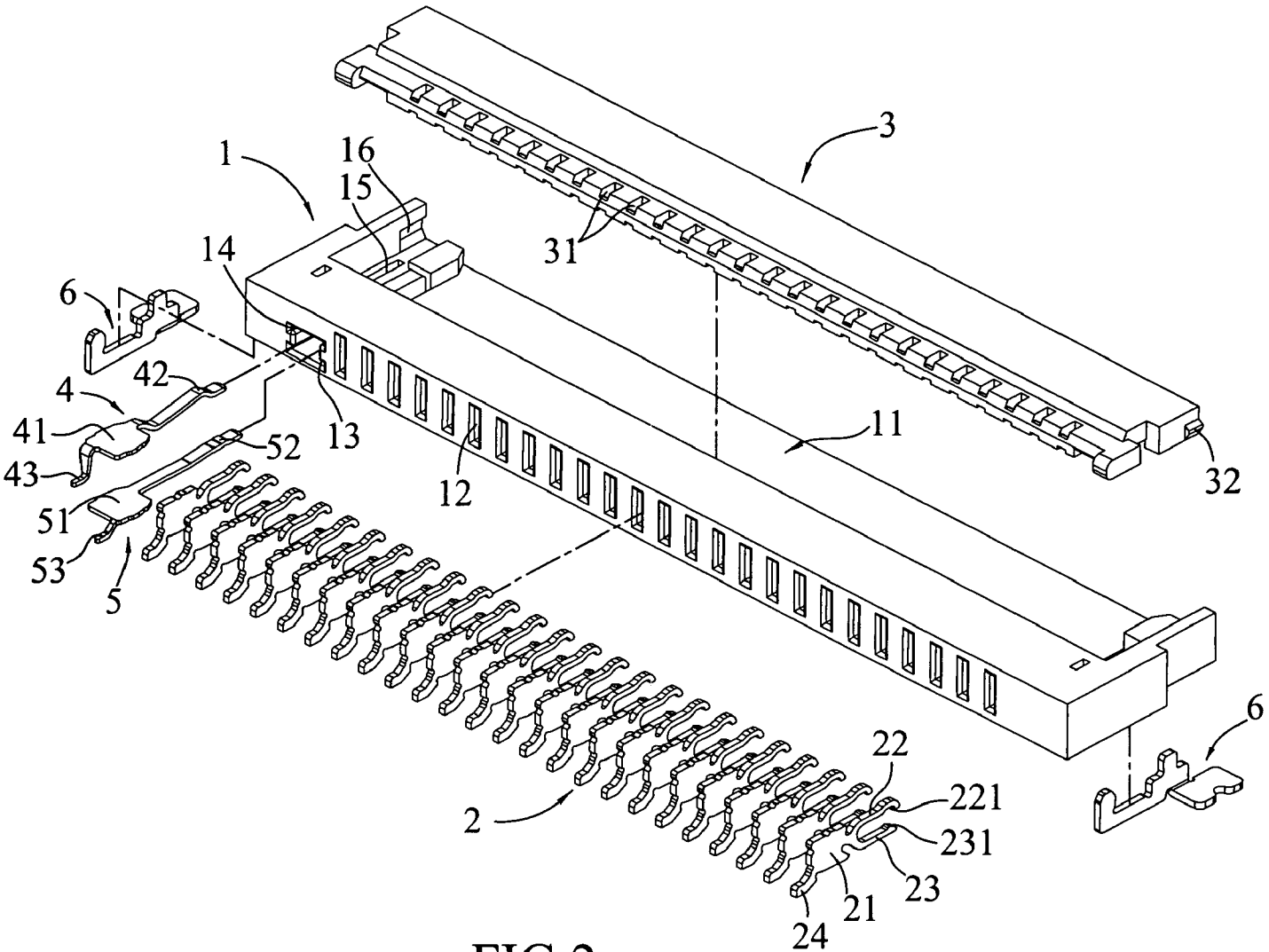
FIG. 2 illustrates an exploded view in another angle of the flexible flat cable connector of the present invention.
Figure 3:
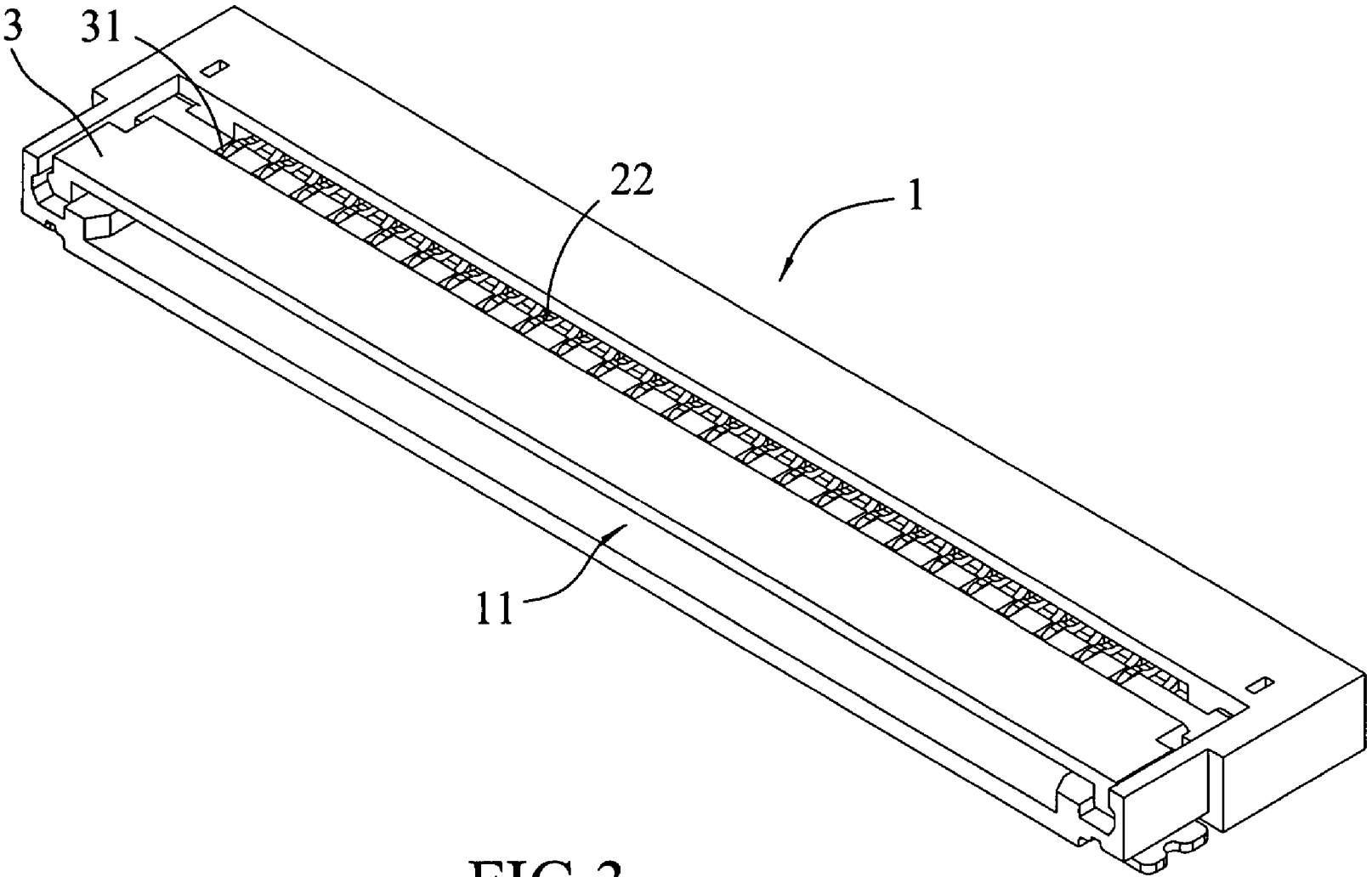
FIG. 3 illustrates a three-dimensional view of the flexible flat cable connector of the present invention.
Figure 4:
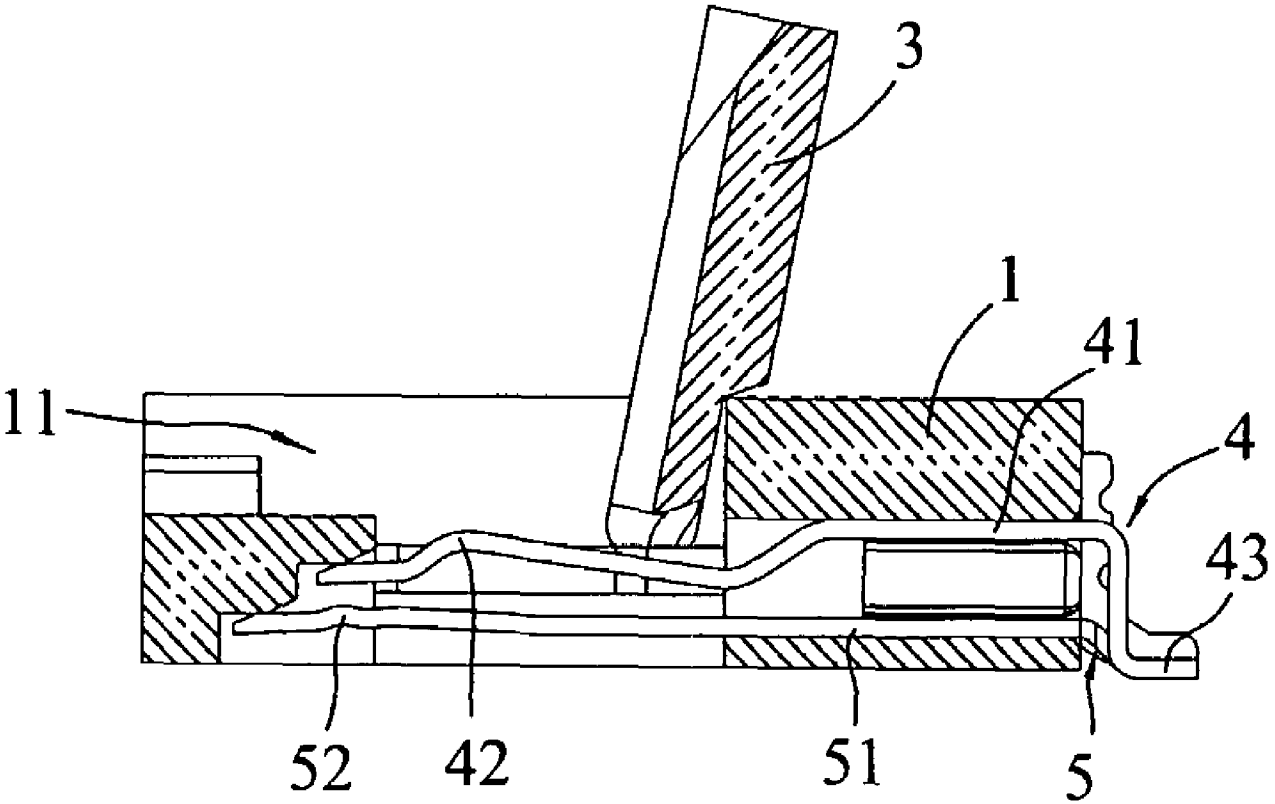
FIG. 4 illustrates a side assembly sectional view of the flexible flat cable connector of the present invention.

To make it easier for our examiner to understand the present invention, the following detailed description with reference to the accompanying drawings of embodiments are given for example, but such preferred embodiment is not intend to limit the scope of the present invention. For simplicity, like numerals are used for like elements as described in the specification of the present invention.

FIG. 1, FIG. 2, FIG. 3 and FIG. 4 illustrate an exploded view, an exploded view in another angle, three-dimensional view and assemble side view of the embodiment of the flexible flat cable connecter in accordance with present invention respectively. The flexible flat cable connector of present invention comprises an insulating body 1, a plurality of conductive terminals 2, a cover 3, a first switch terminal 4, a second switch terminal 5 and a pair of positioning plates 6.

The insulating body 1 is formed a shape of flattened rectangle and has a containing space 11 concaved inside and a plurality of terminal grooves 12 penetrating through the insulating body 1. An upper groove 13 and a bottom groove 14 are disposed on the one side of the insulating body 1. Two positioning grooves 15 having opening bottom are disposed respectively on the two side of the opening of the containing space 11, and two slots 16 are disposed respectively on the two side of the inner surface near to front end of the insulating body 1.

A plurality of conductive terminals 2 are inserted respectively in the terminal grooves 12 from the rear end of the insulating body 1. Each of the conductive terminals has a main body portion 21 which extends forwardly an upper arm 22 and a lower arm 23 being parallel to each other. A pivoting groove 221 is disposed on the front end of the upper arm 22, and a convex contacting portion 231 is disposed on the front end of the lower arm 23. The bottom of the rear end of the main body portion 21 outwardly extends a solder portion 24 which is used for soldering with the circuit board (not shown).

The cover 3 is a structure of flat plate, and a plurality of pivots 31 are disposed equivalently along the rear end of the cover 3, and two buttons 32 corresponding to the slot 16 of the insulating body 1 are disposed on the two side of the front end of the cover 3.

The first switch terminal 4 has a flattened first positioning portion 41 which forwardly extends a first clamping portion 42 which is elastic deformable, and backwardly extends a first solder portion 43 which is used for soldering with the circuit portion.

The second switch terminal 5 has a flattened second positioning portion 51 which forwardly extends a second clamping portion 52, and backwardly extends a second solder portion 53 which is used for soldering with the circuit board.

In assembly process, the conductive terminals 2 are inserted respectively in the terminal grooves 12 from rear end of the insulating body 1. By embedding the main body portion 21 of the conductive terminal 2 in terminal groove 12, the upper arm 22 and lower arm 23 can expose in containing space 11 and the solder portion 24 can protrude out of the rear end of the insulating body 1. Then, the upper arm 22 is slightly bent downwardly so that the upper arm 22 and lower arm 23 can be smoothly placed in containing space 11, and the conductive terminal 2 can be firmly positioned in the terminal groove 12, and the solder portion 24 protrude out of the rear end of the insulating body.

The first switch terminal 4 and the second switch terminal 5 are assembled in the upper groove 13 and bottom groove 14 respectively, and the first positioning portion 41 and the second positioning portion 51 are inserted into the upper groove 13 and the lower groove 14 respectively, so that first clamping portion 42 and the second clamping portion 52 protrude in the two side of the containing space 11, and the first clamping portion 42 is located above the second clamping portion 52, and the first solder portion 43 and the second solder portion 53 protrude out of the rear side of the insulating body 1. After assembly process, the first switch terminal 4 and the second switch terminal 5 are aligned vertically and will not contact with each other. Then, the plurality of pivots 31 on the rear end of the cover 3 are pivoted into the pivoting groove 221 of the upper arm 22, so that the cover 3 can flip up and down on the top of the containing space 11. When the cover 3 flips down, the button located on the cover 3 can be wedged into the slot 16 for firm positioning of cover. Finally, the positioning plates are assembled into the positioning groove 15 located on the two side of the insulating body 1, so as to complete the assembly for the present invention.

Figure 5:
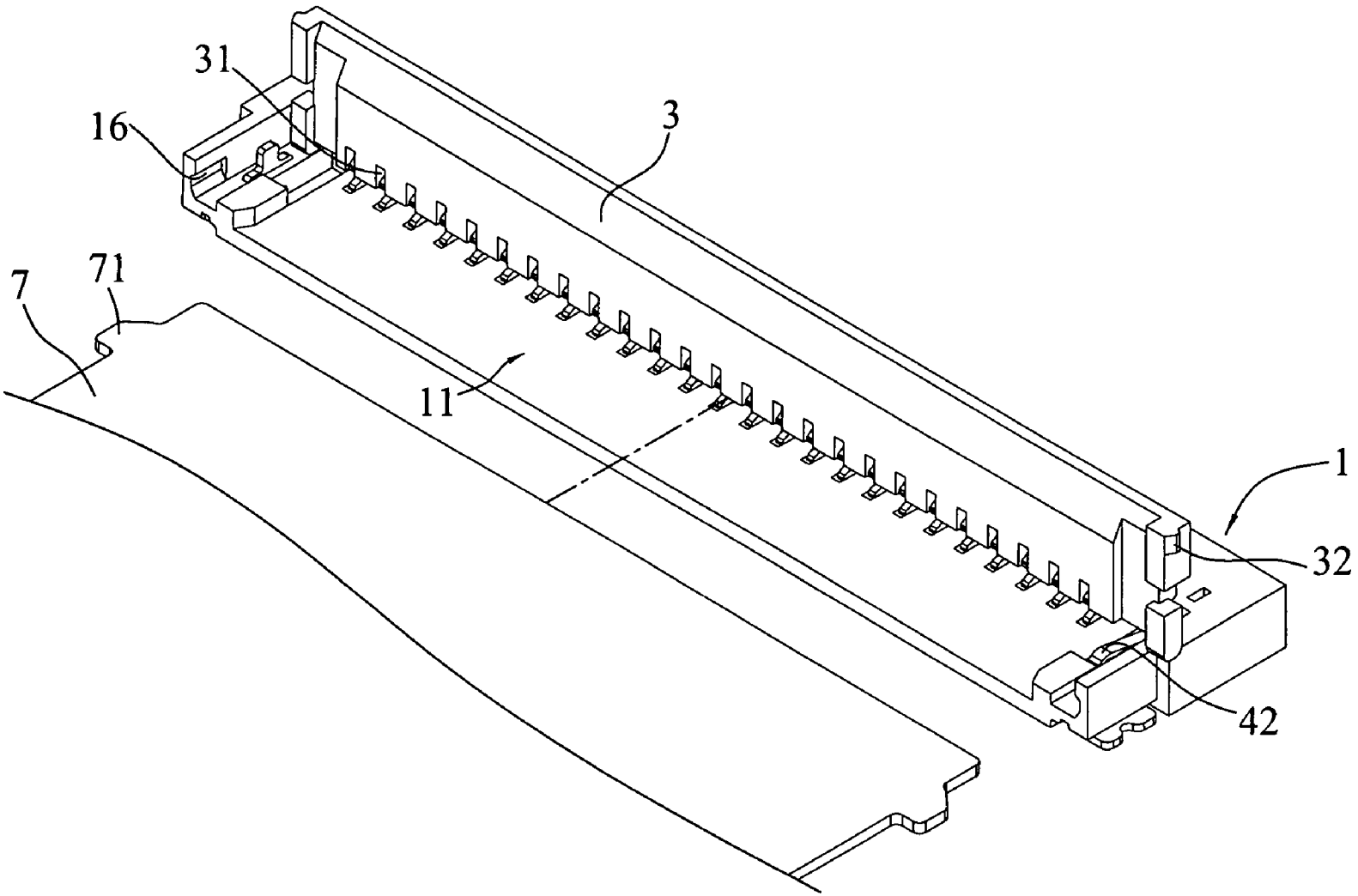
FIG. 5 illustrates an exterior view of the flexible flat cable connector of the present invention before using.
Figure 6:
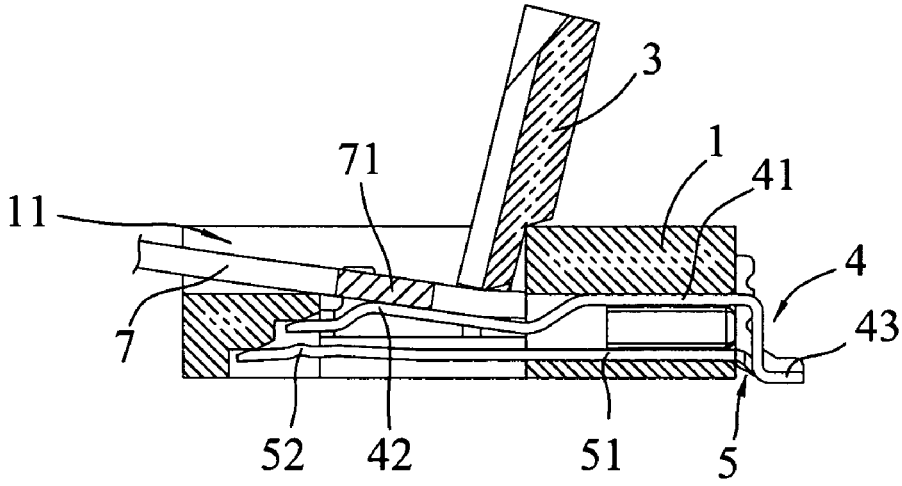
FIG. 6 illustrates a side sectional view of the flexible flat cable connector of the present invention when in using.
Figure 7:
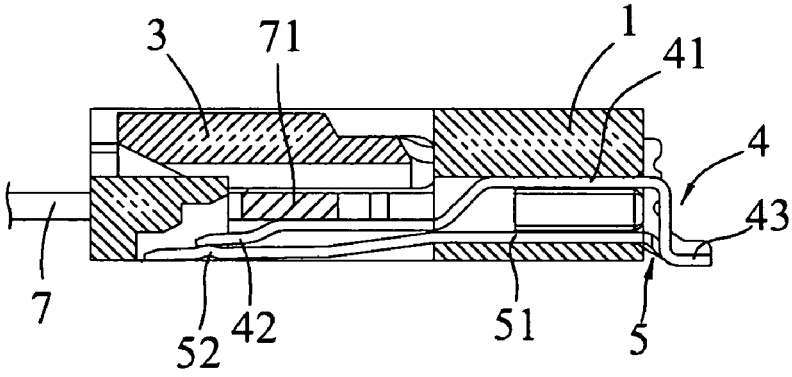
FIG. 7 illustrates a side sectional view of the flexible flat cable connector of the present invention after using.

FIG. 5, FIG. 6 and FIG. 7 illustrate a three dimensional exterior view of the embodiment of the flexible flat cable connecter of the present invention before using, side sectional view of the embodiment of the flexible flat cable connecter of the present invention in use, and side sectional view of the embodiment of the flexible flat cable connecter of the present invention after use.

The flexible flat cable 7 is inserted slantly into the containing space 11 from the front end of the insulating body 1. The lobe 71 of the flexible flat cable 7 is exactly located on the top of the first clamping portion 42 of the first switch terminal 4. By being flipped down, the cover 3 can press the surface of the flexible flat cable 7 so that the lobe 71 of the flexible flat cable 7 presses downwardly the first clamping portion 42 which is then elastic deformed to downwardly contact against the first clamping portion 52. The second switch terminal 5 then detect the flexible flat cable 7 correctly positioned, and the flexible flat cable 7 and the conductive terminal 2 conduct with each other.

The flexible flat cable connector of present invention utilizes a first switch terminal and a second switch terminal disposed on the insulating body, and the structure character provided with the flexible flat cable, when the flexible flat cable is correctly positioned, the lobe can press the first switch terminal which then contacts against the second switch terminal, so as to detect whether the flexible flat cable correctly positioned or not and form a conductive status. Therefore, when being inserted in correct position the flexible flat cable just can conduct electrically; this can prevent wrongly plug or electrical conduct failure and improve the usability of the flexible flat cable.

Besides, the first switch terminal and the second switch terminal are aligned vertically, such arrangement and the pressing direction of the flexible flat cable enable the flexible flat cable to contact with the switch terminals for conducting when the flexible flat cable is inserted and positioned. Therefore, the flexible flat cable connector also has an advantage that the length of the insulating body can be reduce. The first switch terminal and the second switch terminal are disposed on the one side of the conductive terminals so that the lobe structure located on the side of the flexible flat cable can easily press on the top of the first switch terminal, and achieve the function of detecting and conducting.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A flexible flat cable connector, comprising:

an insulating body, having a containing space and a plurality of terminal grooves;

a plurality of conductive terminals, inserted in said terminal grooves, and each of said conductive terminals having a contacting portion and a solder portion extended outside said insulating body;

a cover, assembled with said insulating body and capable of relatively rotating to said insulating body;

wherein at least one switch terminal block is disposed on said insulating body and located at one side of said conductive terminal, and said switch terminal block has a first switch terminal and a second switch terminal aligned vertically; and said cover presses the surface of a flexible flat cable such that a lobe of said flexible flat cable downwardly contacts a first clamping portion of said first switch terminal and said first clamping portion downwardly contacts a second clamping portion of said second switch terminal.

2. The flexible flat cable connector of claim 1, wherein an upper groove and a bottom groove are disposed on the one side of said insulating body, and said first switch terminal is inserted in said upper groove, and said second switch terminal is inserted in said bottom groove.

3. The flexible flat cable connector of claim 2, wherein said first switch terminal has a first positioning portion inserted in said upper groove, and said first positioning portion forwardly extends said first clamping portion which is elastic deformable, and backwardly extends a first solder portion which is used for soldering with a circuit board.

4. The flexible flat cable connector of claim 2, wherein said second switch terminal has a second positioning portion inserted in said bottom groove, and said second positioning portion forwardly extends said second clamping portion, and backwardly extends a second solder portion which is used for soldering with a circuit board.

5. The flexible flat cable connector of claim 1, wherein said flexible flat cable inserts in the containing space of said insulating body, and electrically contacts said conductive terminals, and when said flexible flat cable is inserted in said insulating body, said lobe of flexible flat cable is relatively above said switch terminal block and presses said first switch terminal to conduct to second switch terminal.

6. The flexible flat cable connector of claim 1, wherein said conductive terminal has a main body portion which forwardly extends an upper arm and a lower arm being parallel to each other, and a pivoting groove is disposed on the front end of said upper arm, and a contacting portion is disposed on the front end of said lower arm, and the bottom of the backward end of said main body portion outwardly extends a solder portion.

7. The flexible flat cable connector of claim 6, wherein a plurality of pivots are disposed equivalently along the rear end of said cover, and each one of said pivots is disposed in the pivoting groove of said conductive terminal, so that said cover can flip up and down on the top of said containing space.

8. The flexible flat cable connector of claim 1, wherein two positioning plates are disposed on the two sides of said insulating body.

9. The flexible flat cable connector of claim 1, wherein the at least one switch terminal block blocks the lobe of the flexible flat cable after the flexible flat cable is inserted into the containing space of the insulating body and contributes to stability of connection.

10. The flexible flat cable connector of claim 1, wherein at least a part of the insulating body blocks the lobe of the flexible flat cable after the flexible flat cable is inserted into the containing space of the insulating body and contributes to stability of connection.

11. A flexible flat cable connector, comprising:

an insulating body, having a containing space and a plurality of terminal grooves;

a plurality of conductive terminals, inserted in said terminal grooves, and each of said conductive terminals having a contacting portion and a solder portion extended outside said insulating body;

a cover, assembled with said insulating body and capable of relatively rotating to said insulating body; and a flexible flat cable, inserted into said containing space of said insulating body;

wherein at least one switch terminal block is disposed on said insulating body and located at one side of said conductive terminal, said switch terminal block has a first switch terminal and a second switch terminal aligned vertically, and said cover presses the surface of said flexible flat cable such that a lobe of said flexible flat cable downwardly contacts a first clamping portion of said first switch terminal and said first clamping portion downwardly contacts a second clamping portion of said second switch terminal.

* * * * *